US005763810A

United States Patent [19]

Lee

[11] Patent Number: 5,763,810

[45] Date of Patent: Jun. 9, 1998

[54] AUTOMATIC BULLET FEEDER

[75] Inventor: Richard J. Lee, Hartford, Wis.

[73] Assignee: Lee Precision, Inc., Hartford, Wis.

[21] Appl. No.: 682,304

[22] Filed: Jul. 17, 1996

[51] Int. Cl.[6] ..... F42B 33/00

[52] U.S. Cl. ..... 86/45; 86/23; 86/24

[58] Field of Search ..... 86/19, 23–28, 86/43–46

[56] References Cited

U.S. PATENT DOCUMENTS

| | | | |
|---|---|---|---|
| 3,483,792 | 12/1969 | Williams | 86/27 |
| 4,522,102 | 6/1985 | Pickens | 86/27 |
| 5,179,243 | 1/1993 | Schroeder | 86/25 |
| 5,313,869 | 5/1994 | Lee | 86/25 |

*Primary Examiner*—Harold J. Tudor
*Attorney, Agent, or Firm*—Ryan, Maki, Mann & Hohenfeldt

[57] ABSTRACT

A device for feeding bullets to an ammunition reloading press. A bullet guide member in the device has a vertical bore for allowing bullets to descend by gravity from a stack of bullets in a storage tube one at a time to a small platform. A feeder body is mounted for reciprocating vertically on the guide member and a shuttle is mounted for sliding horizontally relative to the feeder body between a retracted position on the body to a fully advanced position where the bullet picked up from the platform by grippers on the shuttle is aligned with a bullet seating tool and with an ammunition case that is moving upward with the ram of the press. Continuing upward movement of the ram causes the case to be pushed slightly onto the bullet and ultimately the mechanism that moves the shuttle out an in, the feeder body and shuttle rise so the bullet begins to enter the seating die. Continued upward movement of the ram causes the mouth of the bullet seating die to spread the gripping means apart so the bullet and case can continue freely into the die in which the bullet is seated. Reversal of the ram into a descending mode causes lowering of the shuttle and body of the shuttle can retract again for gripping a bullet which has settled on the platform when the shuttle was advancing.

14 Claims, 9 Drawing Sheets

FIG. 2
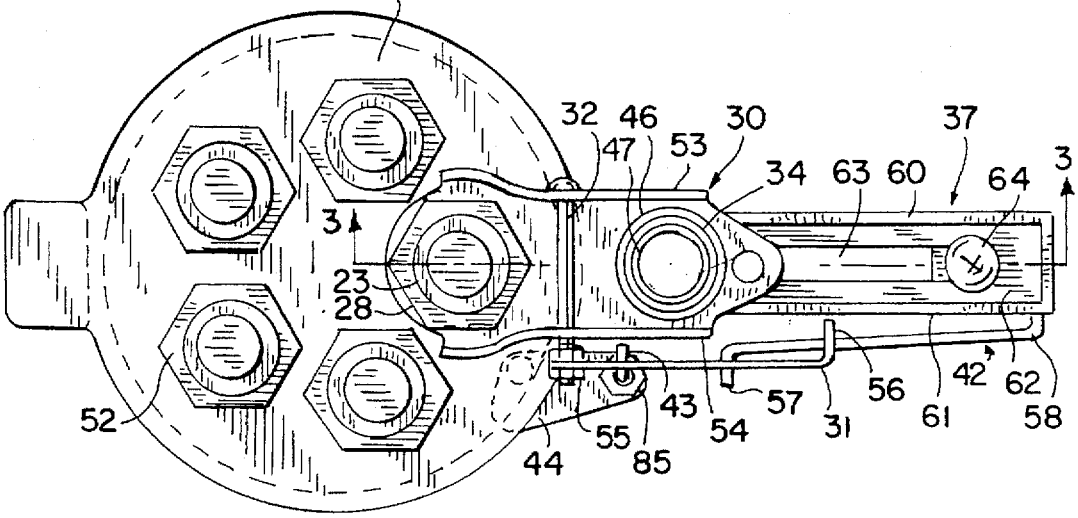
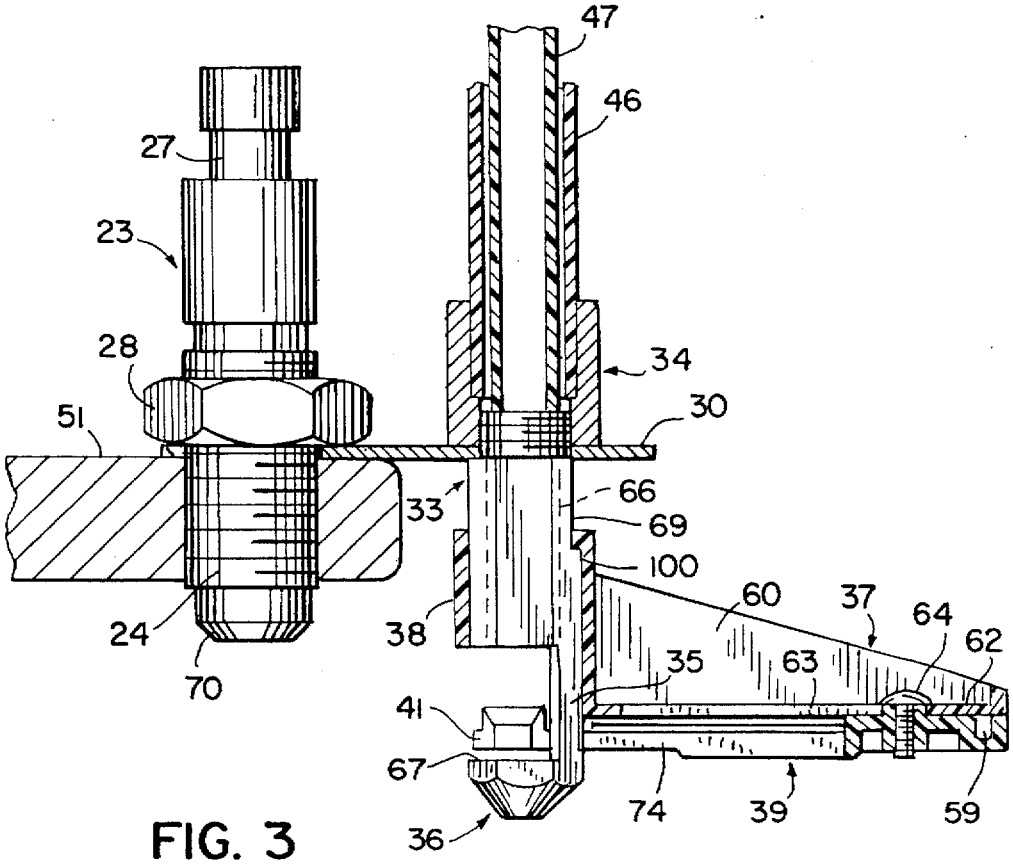
FIG. 3

FIG. 5
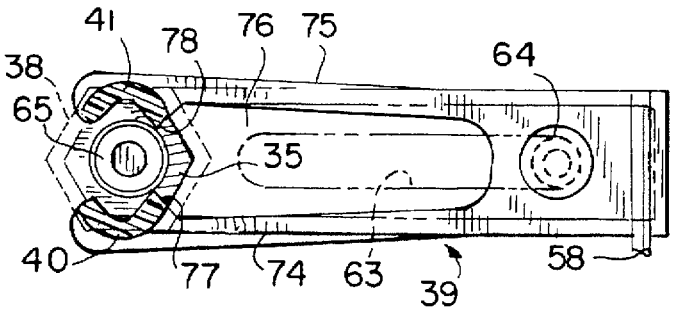
FIG. 6
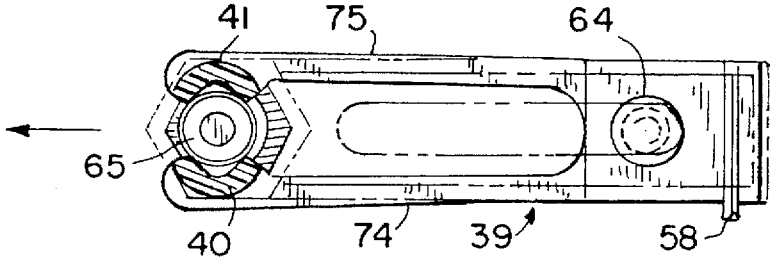
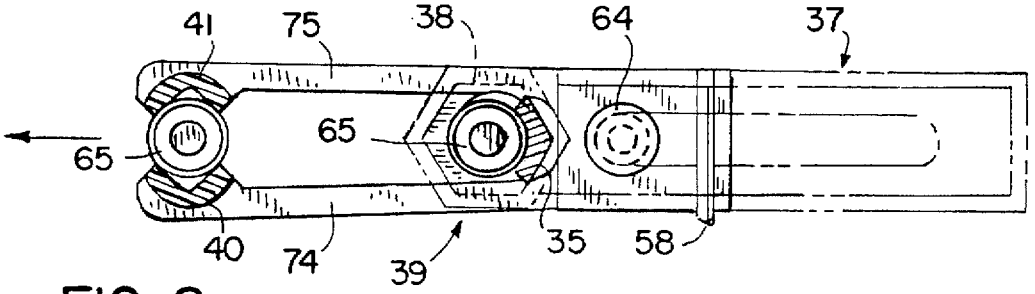
FIG. 8
FIG. 9
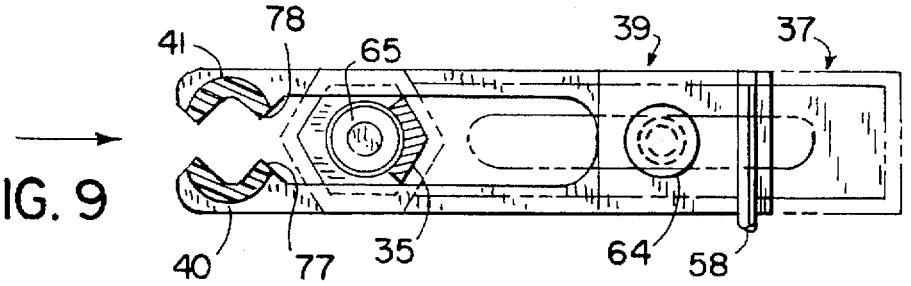
FIG. 10
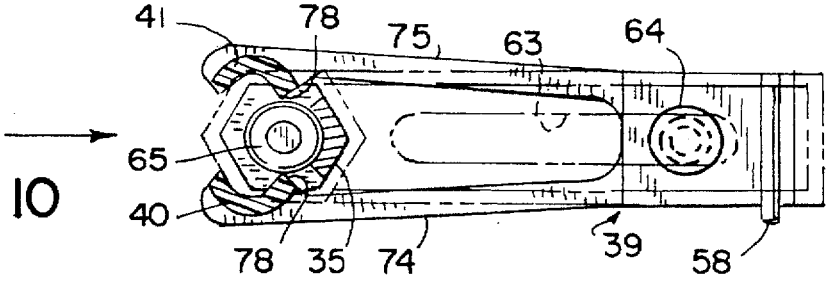

FIG. 11
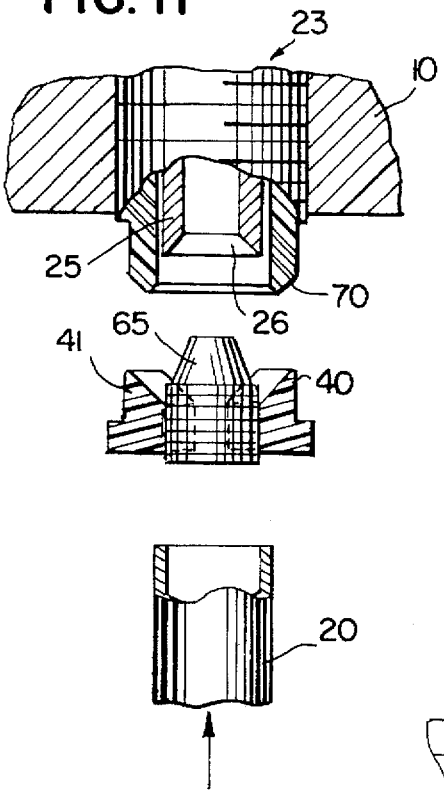
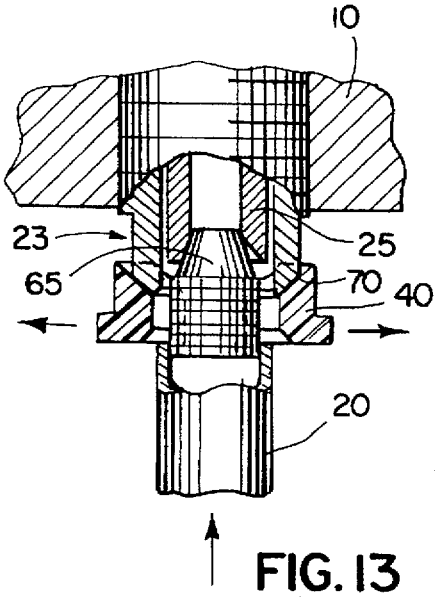
FIG. 13
FIG. 15
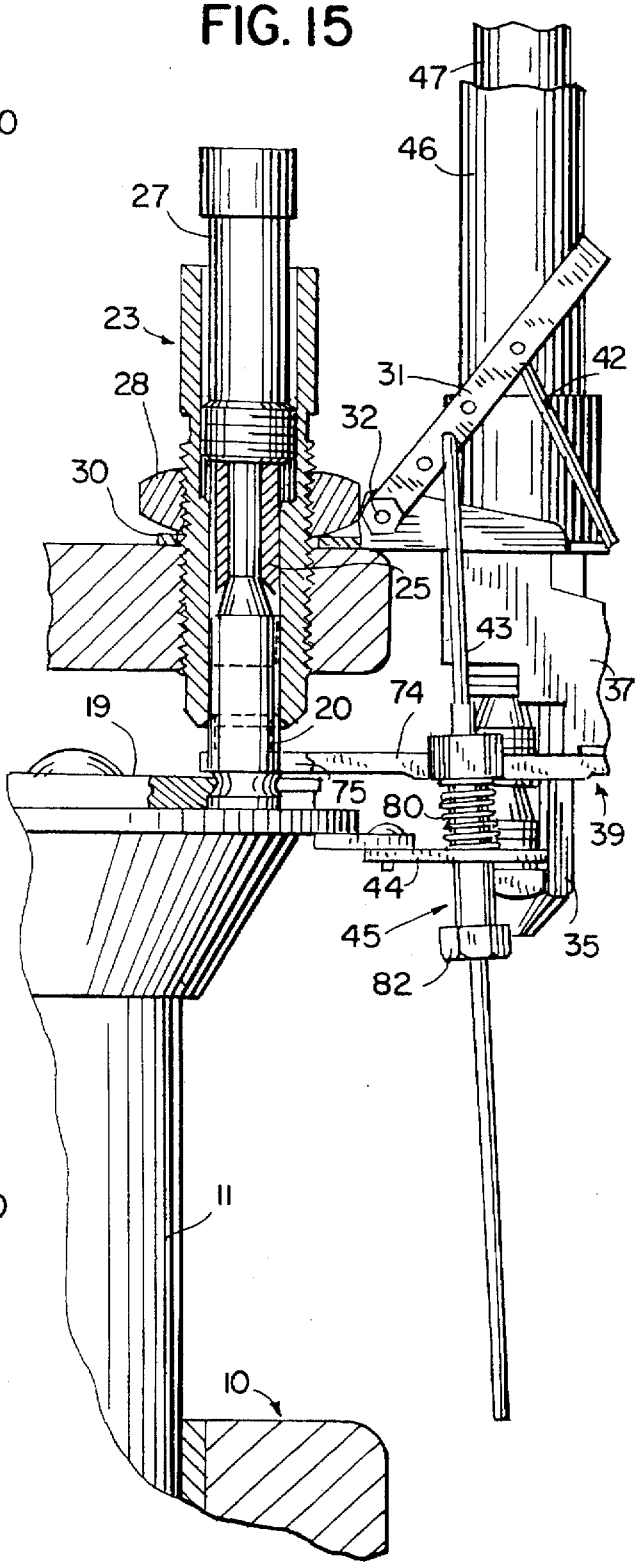

FIG. 16
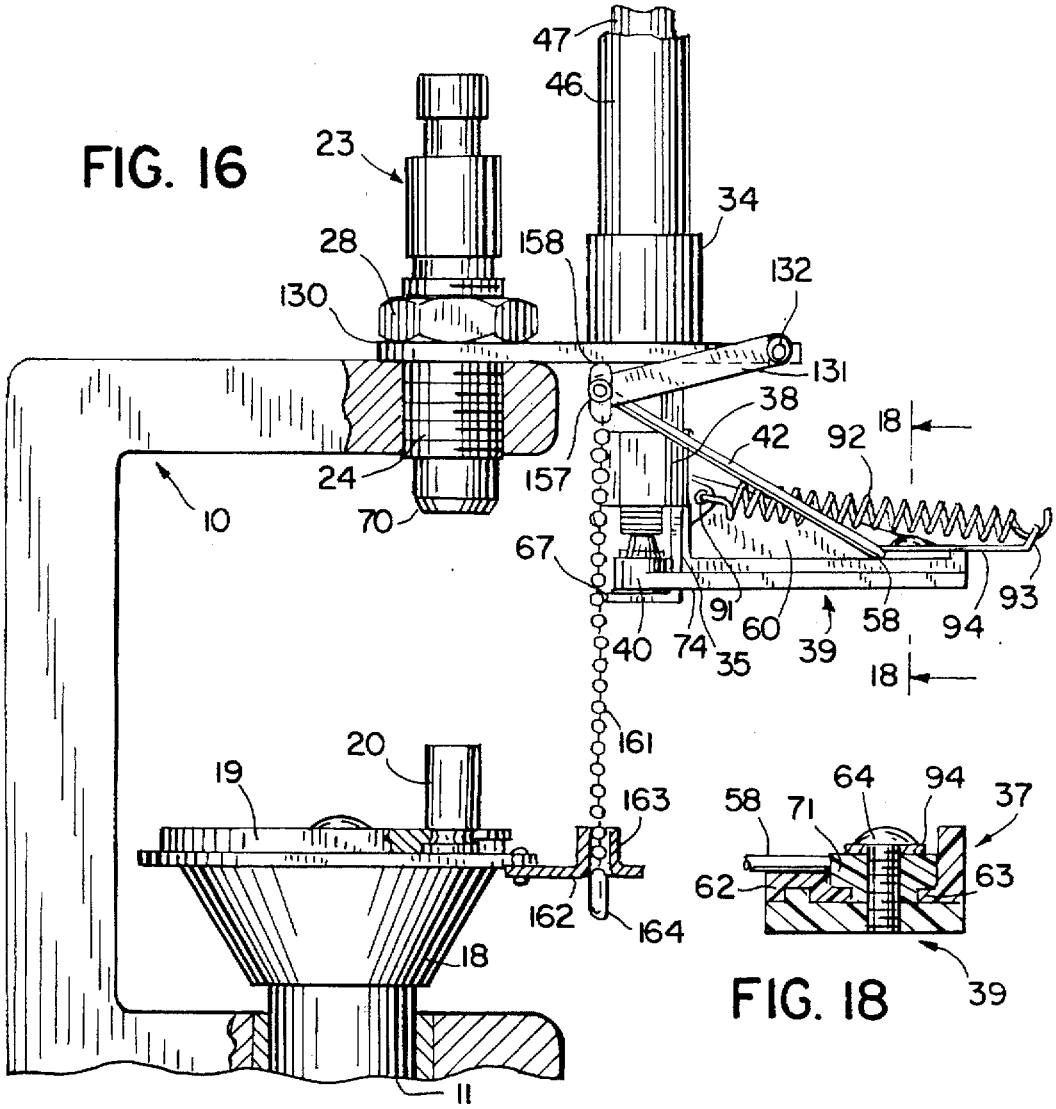
FIG. 18
FIG. 17
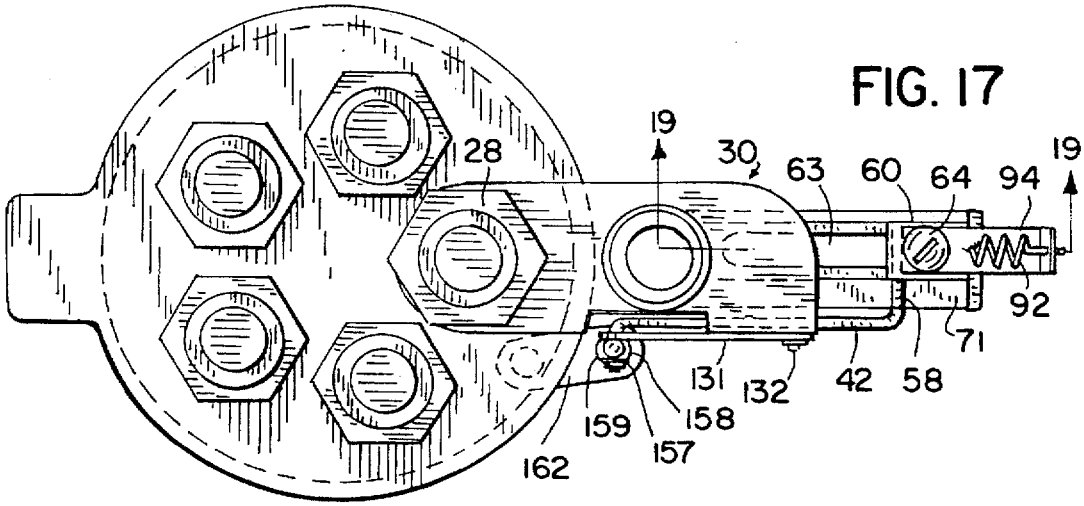

AUTOMATIC BULLET FEEDER

BACKGROUND OF THE INVENTION

The invention disclosed herein pertains to a device for feeding bullets to an ammunition case reloading press for the press to seat bullets in cases as a final operation in a series of case reloading operations.

The most advanced modern ammunition case reloading presses are capable of automatically decapping previously fired cases, inserting live primer caps automatically in the cases, filling the cases with powder automatically and performing other operations in connection with putting spent ammunition cases in condition for being fired again with a weapon. However, a satisfactory device for seating a bullet in the mouth of a case automatically after the case has been filled with powder and otherwise conditioned is not known to having been achieved except for commercial reloading machines. The usual practice is to set the bullet in the case by the operator using his or her fingers.

As is known, typical reloading presses comprise a frame in which a ram is driven up and down by the user swinging an operating lever that is operatively coupled to the ram by means of appropriate linkage. A turret for holding a plurality of equiangularly spaced apart cases in an upright attitude is revolved to index a case by one angular step for each stroke of the ram to place the cases consecutively in alignment with the tools or dies that are correspondingly equiangularily spaced apart on the frame of the press and that perform the individual operations on the cases. The operations are performed sequentially and concurrently. Typically in one station, of a three to five station press, the spent primer is removed and the case sized to specifications. The case is primed in another station, powder is added in another station, the bullet is placed and then seated in and crimped in still another station. All the operations are fully automatic except for of placement of the bullet. Bullet placement requires a pause that adds significantly to the cycle time of the operation. A dexterous operator can place the bullet in about one or two seconds and complete a cycle in three or four seconds. It is readily apparent that bullet placement adds fifty to one hundred percent to the time required for each cycle. An unusually dexterous operator may try to increase production rates by picking up and inserting the bullet with finger 5 on one hand while cranking the ram operating handle with the other hand so the ram and case are in motion or slow down while the bullet is being set into the mouth of the case on its way to the bullet feeder tool. Even if the user is sufficiently dexterous to set a bullet in the case on the fly it is not recommended because there is a probability of a finger on the hand getting in between the bullet and the die or tool when the bullet is being pressed into the bullet seating die in which circumstance serious injury to the person could result.

SUMMARY OF THE INVENTION

The foregoing problems of possible personal injury and low production rates in preexisting hand operated ammunition case reloader presses are overcome with the aid of the new automatic bullet feeder disclosed herein.

According to the invention, the new automatic bullet feeder comprises a support plate which provides for mounting a mechanism of the bullet feeder to a reloader press adjacent the die or tool that is involved in seating and possibly crimping the bullet in a case. A guide member having a vertical bore through which a bullet can drop is fastened to the support plate underneath the plate. A bullet storage tube for containing a stack of bullets is coupled to the upper end of the vertical bore of the guide member. A vertically oriented extension element extends downwardly from the guide member and terminates in a pedestal or element having a flat top surface on which one bullet at a time can drop from the storage tube and come to rest on the pedestal. A bullet feeder body that has a neck in which there is a bore is mounted to the guide member for reciprocating between upper and lower limits. A shuttle is mounted on said body for reciprocating horizontally between a retracted limit and an advanced limit. The shuttle has bullet gripper elements or jaws at its leading end. The jaws are spring biased toward each other. When the shuttle is in retracted position, its jaws are positioned over the flat surface of the pedestal. The shuttle is constructed such that when it starts to advance its gripper jaws take a bullet from the pedestal for the shuttle to advance the bullet into alignment with a bullet case on the turret of the ammunition reloading press and with the bullet seating die concurrently. Meanwhile an open space on the shuttle allows another bullet to settle on the pedestal. When the shuttle is almost fully retracted after having given up its bullet to a case in advanced position, the jaws encounter the replacement bullet on the pedestal and grip the bullet in readiness to advance it to alignment with a case and the bullet seater tool during the next stroke of the ram of the reloading press.

How the foregoing objectives, operational steps and structural features are implemented in the new automatic bullet feeding device will appear in the more detailed description of a preferred embodiment of the invention which will now be set forth in reference to the accompanying drawings.

DESCRIPTION OF THE DRAWINGS

FIG. 2 is a more realistic top plan view of a typical press wherein the multiplicity of usually present dies are shown arranged in a circle and the new bullet feeding device is mounted to the press;

FIG. 3 is a fragmentary view of part of the press and parts of the bullet feeder, in section, showing a bullet seating tool screwed into the head of a press and showing mostly in section, parts of the new bullet feeder from which the operating linkages have been omitted to allow better visualization of other parts;

FIG. 5 is a top plan view of the bullet feeder shuttle at a time when it has reached its retracted position wherein its gripper jaws are still partly deflected apart due to spreader over the bullet on the pedestal;

FIG. 6 is structurally similar to the preceding figure except that the shuttle is now slightly advanced due to wedging of the gripper jaws against the spreader and a bullet is now securely gripped between the gripper jaws of the shuttle and the bullet is ready to be advanced to alignment with a bullet seating tool and an ammunition case;

FIG. 8 is a top plan view of the shuttle, taken on a line corresponding to 8—8 in FIG. 7, showing the shuttle and bullet carried between the jaws thereof in fully advanced position;

FIG. 9 is a top plan view of the shuttle showing it in the process of being retracted after having had the bullet forced from between the gripper jaws by means of the ascending ammunition case on the turret of the press ram;

FIG. 10 is a top plan view of the shuttle showing it nearly fully retracted and with the flexible gripper jaws spread apart as the jaws pass over the bullet so the jaws will deflect toward each other when the shuttle is fully retracted;

FIG. 11 is a fragmentary isolated sectional view showing a bullet in the gripper jaws of the shuttle with the bullet case ready to be forced between the gripper jaws for spreading the jaws and for the case to accept the bullet and lift the bullet into a bullet seating tool;

FIG. 13 is a fragmentary isolated sectional view showing the bullet entering the mouth of the bullet seating die and showing how the beveled lower extremity of the bullet seating die causes the gripper jaws to spread apart from the bullet and case to allow the bullet and case to enter the seating die up to a limit;

FIG. 15 shows the ram of the ammunition case reloading press at its uppermost limit and shows the bullet having forced a cylindrical seater element to its vertical limit of travel to thereby fully seat a bullet in the case;

FIG. 16 is a side elevational view of an alternative embodiment of the bullet feeder;

FIG. 17 is a top plan view of the embodiment of the bullet feeder illustrated in the preceding figure;

FIG. 18 is a vertical section taken on a line corresponding with 18—18 in FIG. 16;

DESCRIPTION OF A PREFERRED EMBODIMENT

Figure 1:
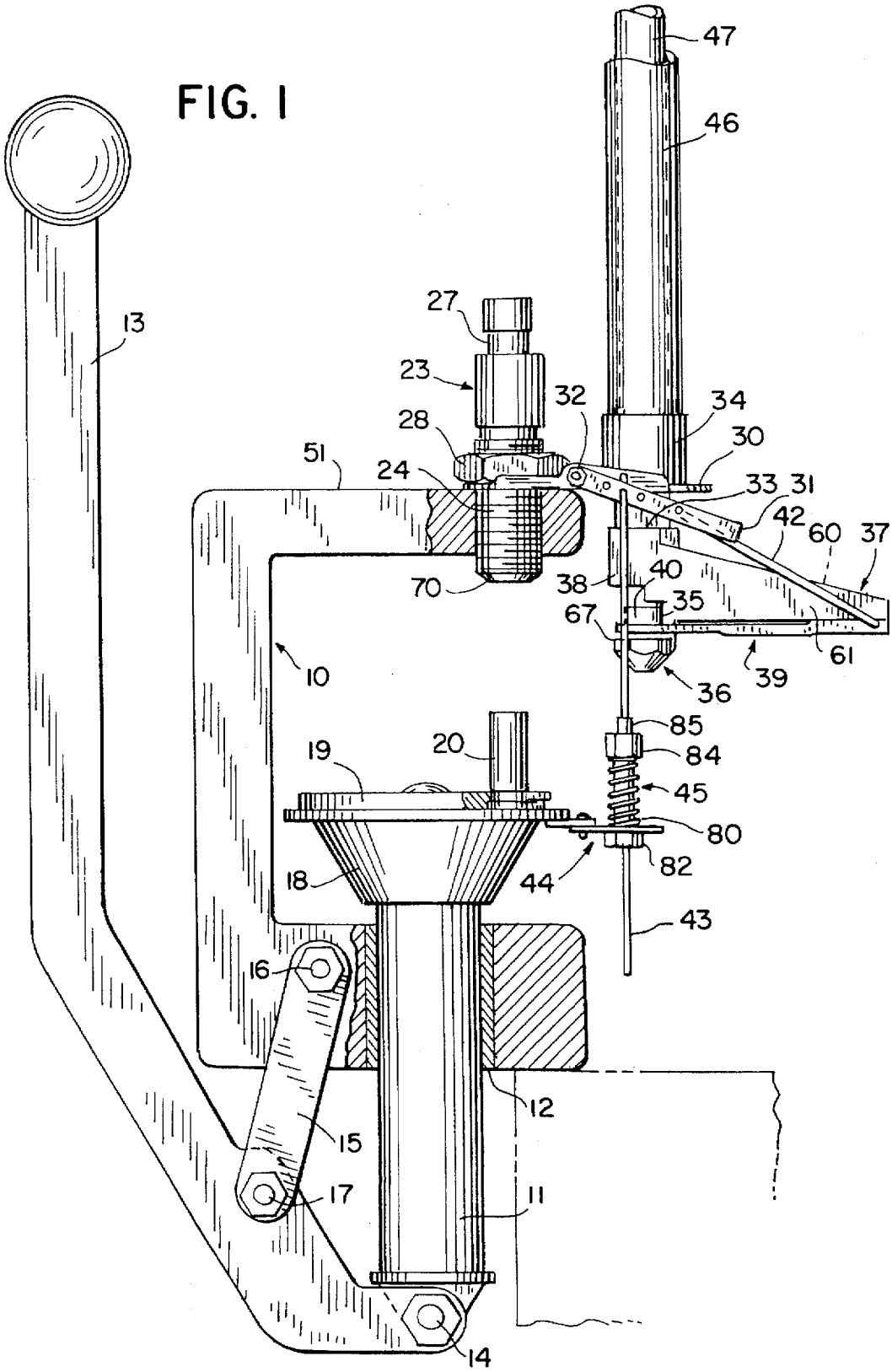
FIG. 1 is a side elevational view of the new bullet feeder mounted to an ammunition case reloading press wherein only the tool or die that is used to seat the bullet in a case is shown.

FIG. 1 shows a rudimentary or conventional ammunition case reloading press that is useful for demonstrating the construction and operation of the new automatic bullet feeder. The press is comprised of a frame 10. A ram 11 is installed in frame 10. The ram is presently at its lower limit position in FIG. 1. A bushing 12 through which the ram reciprocates vertically is fixed in frame 10. The frame is driven from its lower limit position to an upper limit and back to its lower limit by swinging operating level 13 down and up. The press operating level is pivotably connected with a pin 14 to the lower end of the ram 11. A link 15 is pivotably connected to frame 10 by means of a pin 16 and is pivotably connected to the operating level 13 by means of a pin 17. This operating linkage for a press is well-known.

The upper end of ram 11 has a chamber 18 mounted to it. A turret plate 19, usually called a shell plate, is mounted on the chamber. The details of the components that are present in the chamber 18 for driving the turret plate 19 about its vertical axis in equiangular steps in response to the ram being returned from an upper limit to a lower limit are not shown since artisans who are involved in the design of ammunition reloading presses are familiar with turret rotation mechanisms. A suitable turret drive mechanism and ram assembly is illustrated in U.S. Pat. No. 5,313,869. The patent is owned by the assignee of this application. Incidentally, the patent shows an automatic primer feeder device and automatic powder feeder. The turret or shell plate in FIG. 1 is provided with peripheral notches, as is conventional, for accepting and transporting a plurality of ammunition cases in equiangular steps. Only one case 20 is shown in the drawings since it is sufficient for demonstrating how the new bullet feeder is constructed and operates.

The illustrated die which acts on the ammunition cases is designated generally by the reference numeral 23 and is the die involved in seating bullets in ammunition cases 20. It is assumed that the case 20 shown in FIG. 1 is fully reconditioned at this time by various tools or dies that ordinarily act on the case and that the case is filled with powder and ready for insertion of a bullet. In FIG. 1 the case 20 that is next to be acted upon by the bullet seating die 23 is indexed in vertical alignment already with die 23. In most ammunition reloading presses, the turret 19 indexes one angular step each time the ram is at or near its lower limit so that when the ram is started to be driven upwardly again the cases 20 are aligned already with the tools or dies that are to act on the cases next. Typical bullet seating die 23 has an external thread 24 to provide for screwing die into a mating internal thread in the press. A slidable bullet seating element 25 (visible in FIG. 12) is restrained against falling out of the body of the die 23. The tip of the bullet 65, which is not yet installed in case 20 in FIG. 1 enters the internally beveled mouth 26 of the seating element 25 when the case is elevated by ram 11 (as in FIG. 12). The seating element 25 recedes until it becomes stopped by an adjustable stop 27 which screws into the body of die 23. The stop 27 is adjusted such that the seating element 25 can only allow the bullet to be forced into the case 20 as far as is required to meet specifications. The die is secured against changing its position by means of a locknut 28.

The parts of the new automatic bullet feeder will now be identified generally in reference to FIG. 1. The feeder is comprised of a rigid support plate 30 which supports the entire feeder mechanism in cantilever fashion. Plate 30 is suitably apertured to provide for it to be slid onto the threaded shank 24 of die 23 and clamped by hexagon nut 28. A link 31 which has a plurality of holes is pivotably connected by means of a pin 32 to support plate 30. A bullet guide member 33 is secured against the bottom surface of support plate 30. Guide member 33 is preferably a metal part whose outside perimeter is hexagonal in shape and has a vertical bore 66 (see FIG. 3) which serves as a bullet feed passageway. A preferably metal cylindrical adapter 34 is internally threaded, not visible in FIG. 4, and screws onto the bullet guide member 33 to thereby secure the guide member against the bottom surface of support plate 30. The bullet guide member 33 has an integral vertical extension 35 which is easily visualized in FIG. 3. Vertical extension 35 terminates at its lower end in a flat topped bullet receiving pedestal 36 having a platform 67.

A bullet feeder body which is preferably molded of resin, is designated generally by the numeral 37. The body has two side walls 60 and 61. The side wall 61 in the foreground appears in FIG. 1 and the sidewall behind it and in parallel with it appears in FIG. 3. A neck 38 is molded integrally with the side walls of feeder body 37. The neck 38 has a hexagonal bore to provide for the body being slidable up and down within limits on hexagon shaped bullet guide member 33. The hexagon bore in neck 38 and the hexagon bullet guide member 33 are thus connected in a manner equivalent to a spline. A slidable bullet shuttle 39 is mounted to the bottom of feeder body 37 in a manner that permits the shuttle to be driven horizontally from its fully retracted position in which it is shown in FIGS. 1 and 3 to an advanced position as will be discussed in more detail shortly and hereinafter.

The shuttle is provided with bullet gripper jaws, one of which 40, is visible in FIG. 1. Its cooperating jaw 41 may be seen in FIG. 5, for instance. Shuttle 39 is operatively coupled to perforated link 31 by means of a crank 42. The bullet feeder is actuated by actuator rod 43 which is connected to the ram by means of an attachment plate 44 and an intervening accumulator assembly 45.

Adapter 34 shown in FIG. 1 and other FIGURES is designed for having preferably transparent plastic bullet storage tubes 46 and 47 fitted into it. When seating comparatively small diameter bullets, inner bullet storage tube 47 will contain a stack of bullets 65 as exhibited in FIG. 4. When seating larger diameter bullets, the press operator will have withdrawn inner tube 47 to allow filling the larger diameter bore of outside concentric tube 46 with a stack of bullets.

Refer now to FIGS. 2 and 3 for a more detailed discussion of parts which have heretofore been only generally identified. In FIG. 2 the top of the press 10 frame is marked 51 and is circular which is the most common configuration among reloading presses. The several additional dies such as the die marked 52, are usually present in presses for driving out spent primers, shaping the cases, filling cases with powder and so forth. The support plate or bracket 30 for the bullet feeder is shown clamped under nut 28 to the press top 51. Pivot pin 32 is journaled for rotation in holes in the sidewalls 53 and 54 of support plate 30. The link 31 having the plurality of holes is fastened to the pivot pin 32, which has a threaded end, by a clamping nut 55 which squeezes the link 31 against a backup nut on pin 32 as shown. Link 31 has a right angular bend 56 at its end to stop it from passing crank rod 42. One end 57 of crank 42 extends through one of the holes in link 31 and the other end, 58, extends into a notch 59 in shuttle 39 which is closed at its top by the bottom 62 of the feeder body 37. The notch 59 can be seen in FIG. 3. Feeder body 37 has opposite parallel sidewalls 60 and 61 that are integrated with bottom 62. The bottom 62 has an elongated slot 63. The head of a screw 64 is wider than slot 63 and the shank of the screw is turned into shuttle 39 to provide for the shuttle being supported as it is being driven horizontally to the left from its fully retracted position in which the shuttle appears in FIG. 3.

In FIG. 3, one may see the bore or passageway 66 through which the bottom bullet of a stack of bullets in a storage tube 46 or 47 settles onto the flat platform surface 67 on pedestal 33 at appropriate times in the bullet seating cycle as will be explained later. It will be evident that feeder body 37 can not turn on bullet guide member 33 because the opening in neck 38 of the body 37 being hexagonal and mating the hexagonal exterior of guide member 33. Neck 38, however, can slide up and down on the hexagonal bullet feed member 66. In FIG. 3, the neck 38 and body 37 to which it is attached is shown in its lower most position. The neck can slide upwardly until it abuts support plate 30 and can slide downwardly until it abuts stop shoulder 100 in FIG. 3.

For a reason that will be shown to be important later one should observe in the drawings that the lower extremity of the bullet seater die 23 is beveled as where the lead line from the numeral 70 terminates.

Figure 4:
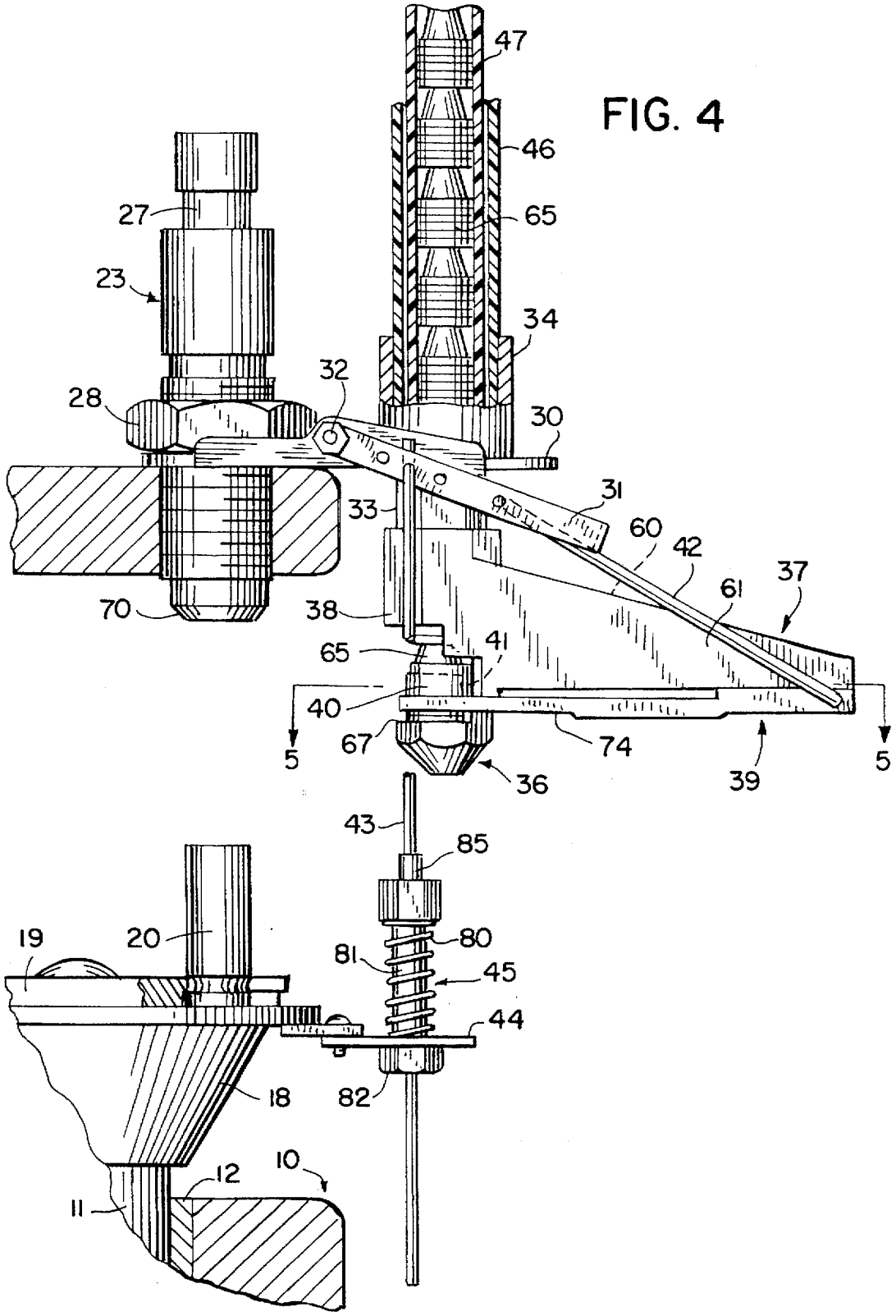
FIG. 4 is a partial sectional view and mostly full line view of the bullet feeder having a stack of bullets in its feed or storage tube wherein the bullet feeder and the press parts are shown in a state of operation which will be followed by setting a bullet in an ammunition case that is primed is filled with powder.

FIG. 4 shows the parts of the reloading press and the new automatic bullet feeder mechanism in readiness for beginning to perform a bullet seating operation on an ammunition case 20 which is assumed to be filled with powder already. The bullet seating operation will be explained. Feeder body 37 is shown in FIG. 4 at its lower limit. One bullet 65 has settled from the stack of bullets in tube 47 onto platform 67 of pedestal 36. The bullet is presently gripped between the spring biased gripper jaws 40 and 41 which are integral with the distal ends of two spaced apart deflectable spring fingers 74 and 75 of the shuttle which are shown in the plan view of shuttle 39 in FIG. 5 which will be discussed hereinafter. It will be evident later that the bullet 65 that is on platform 67 of pedestal 36 in FIG. 4 settled from the bullet stack onto the pedestal through the space between fingers 74 and 75 of the extended shuttle while the shuttle was moving a bullet into vertical alignment with the case 20 and die 23. This function will be described in more detail hereinafter.

Figure 7:
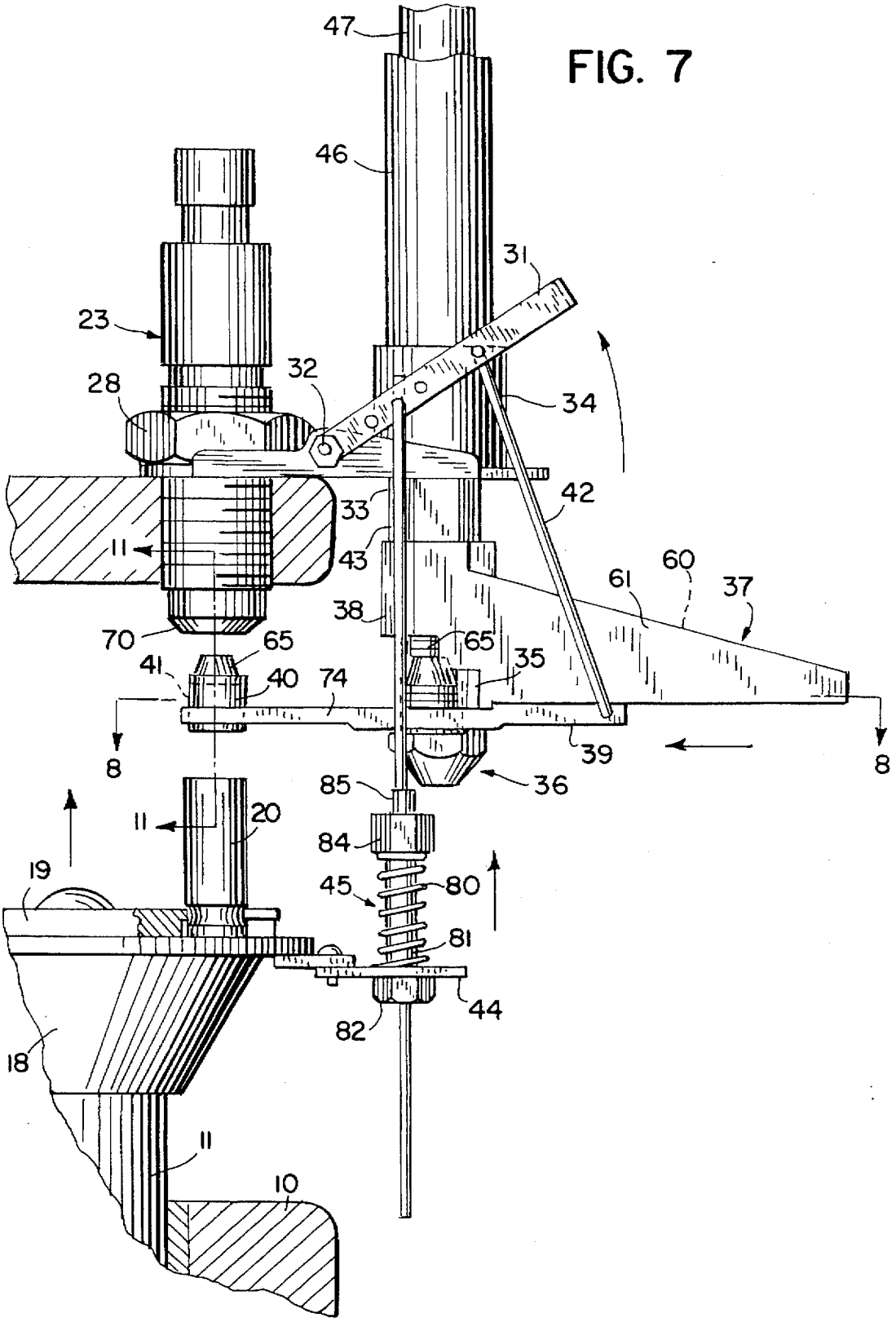
FIG. 7 is a side elevational view showing how the bullet has been advanced by the shuttle into alignment with the bullet seating die and with the ammunition case which is presently ascending with the press ram.

Attention is now invited to FIG. 7. In this FIGURE, ram 11 has begun to ascend from its lowermost limit in which it is depicted in FIG. 4. In this figure, shuttle 39 is at its horizontally advanced limit and a bullet 65 is held in cooperating jaws 40 and 41 on the shuttle. The ammunition case 20 is aligned with bullet seating die 23 and the seating element 25 in the die. Attachment plate 44, of course, goes up and down with ram 11. The actuator rod 43 drives shuttle control link 31 in which the rod is hooked and movements of link 31 affect the angular position of crank 42. Crank 42 drives the shuttle because attachment plate 44 is really an extension of the ram which drives actuator rod 43 upwardly through an intervening buffer-dampener 45 and in particular, by the lifting and compressive force of attachment member 44 on spring 80 of the accumulator.

Figures 12, 14:
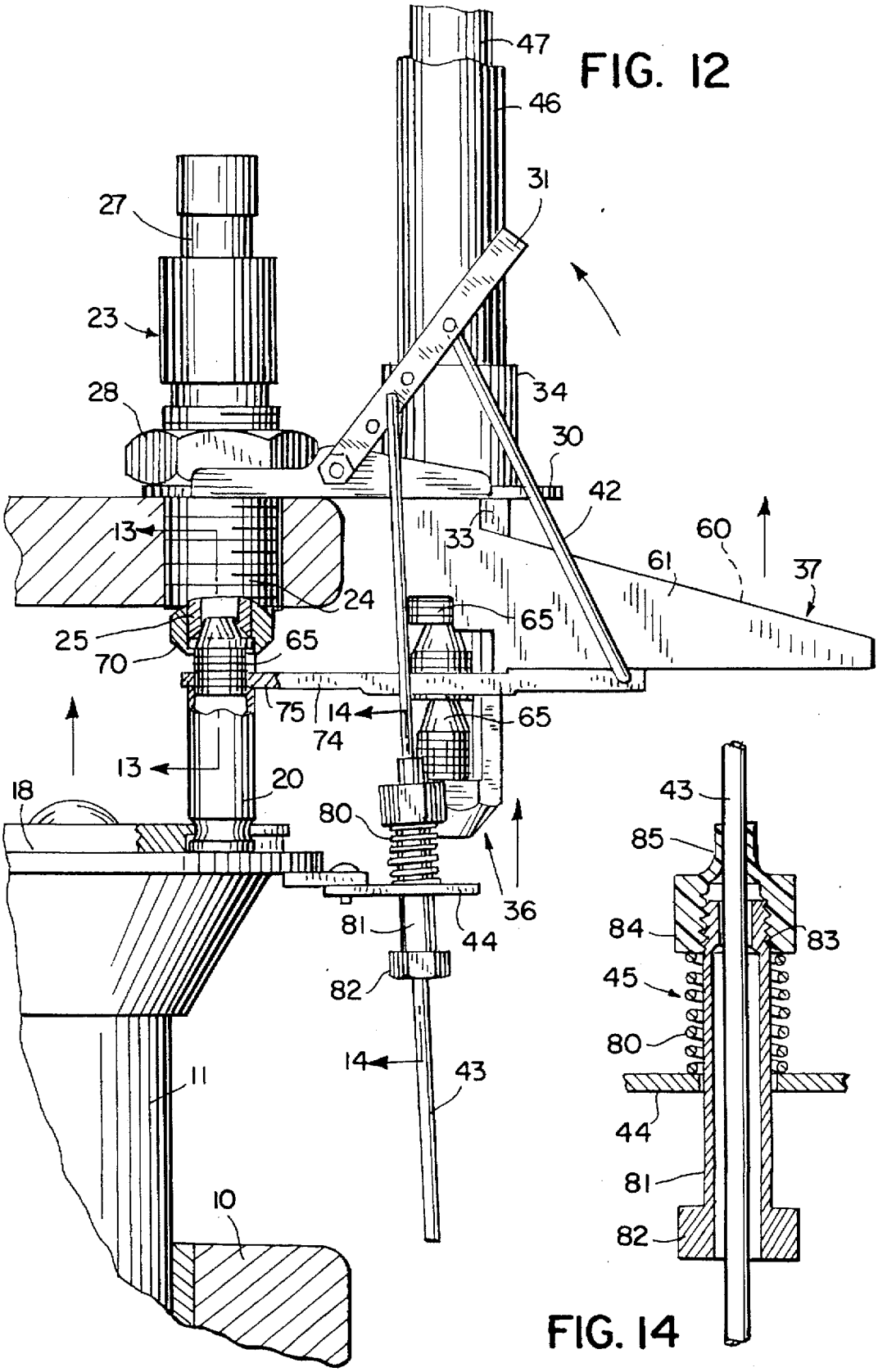
FIG. 12 shows the bullet feeder in a state wherein the bullet is being entered into the bullet seating tool.
FIG. 14 is an isolated sectional view of an accumulator assembly used in the new automatic bullet feeder.

FIG. 14 shows the accumulator 45 in detail. It comprises a metal tubular element 81 that has a hexagon head 82 on its lower end and has a thread 83 on its upper end. Thread 83 screws into a mating thread in an element 84 which has an extension 85 that frictionally engages with actuator rod 43. Friction element 84 is made of nylon in a commercial embodiment but it could be made of other materials of comparable frictional qualities and elasticity. The integral extension 85 of accumulator 45 is thin enough for its inherent elasticity to effect a frictional grip or driving force on actuator rod 43. The friction grip of device 45 on actuator rod 43 allows the device to slip on the rod if there is overtravel of the ram at the end of its upstroke or downstroke so that the shuttle mechanism can never be damaged by excess force from the ram.

Observe in FIG. 7 that another bullet 65 has settled from the bottom of the stack of bullets in the storage tube 47 and the bullet is standing upright on the flat platform 67 pedestal 36. How the bullets are carried by the shuttle 37 to a position in alignment with the bullet seater die 23 will be elaborated beginning with a discussion of FIG. 5.

In FIG. 5, shuttle 39 is at its fully retracted or home position. Before beginning of the shuttle to retract from its advanced position in which it was shown in FIG. 7, the bullet within the jaws 40, 41 of the shuttle was accepted in the mouth of the ascending ammunition case 20. One may see in FIG. 5 that the jaws 40 and 41 project integrally and upwardly from the flexible fingers 74 and 75, respectively. The jaws 40 and 41 are curved. They have beveled edges 77 and 78 and are spring biased toward each other by spring shuttle fingers 74 and 75 which makes it easier for the jaws to slide onto a bullet under the influence of the retracting shuttle 39. Bullet 65 in FIGS. 4 and 5 settled on platform 67 of pedestal 36 through the space 76 between springy flexible fingers 74 and 75 of the shuttle 39 as soon as the shuttle began to advance the jaws out of the way of the descending bullet.

In FIG. 6, shuttle 39 is advanced slightly. In this circumstance the bullet 65 on the platform 67 is now gripped between the jaws 40 and 41 of the fingers 74 and 75, and the bullet 65 is engaged by the bevel edges 77 and 78 of the respective jaws. The shuttle is ready to extend or advance in FIG. 6 to a position wherein it aligns the bullet in the jaws with the ascending casing 20.

In FIG. 8, the shuttle 39 is fully advanced and has placed the bullet held by jaws 40 and 41 into alignment with ammunition casing 20 and with bullet seater die 23. In FIG. 8 the bullet 65 is in the position between the jaws for being engaged by the ascending ammunition case 20 for being pushed out from between the jaws and into a bullet seating die.

In FIG. 9, shuttle 39 is retracting again so the presently empty jaws 40 and 41 will acquire the bullet 65 which has settled on the pedestal 36 when the shuttle 39 moved the bullet in its jaws out of the way.

In FIG. 10 the shuttle 39 is returning in the direction of the arrow towards its completely retracted position and the edges 77 and 78 of the gripper jaws are about to toggle over the diameter of the bullet to attain the condition depicted first in FIG. 5 and then in FIG. 6 as tension on rod 43 is relaxed.

Pressure from the ascending ram is transmitted to the shuttle through the accumulator spring 80, friction element 85, action rod 43, link 31 and crank 42. This pressure first compresses the accumulator spring. Continued pressure overcomes break-away friction of the bullet stack against the bullet in the grasp of the jaws 40 and 41. The accumulator spring quickly accelerates the shuttle, with its bullet, from beneath the bullet stack and allows the stack to stop against platform 36 without interference of the jaws or bullet within the jaws. The acceleration by this spring is greater than the acceleration of gravity on the stack of bullets. This feature makes the operating speed of the lever irrelevant as the bullet is always quickly jerked from the bottom of the stack. This is the significant modification to the alternate embodiment that functions fine, but requires the lever be moved rapidly else the fall of the stack of bullets is disrupted and causes a malfunction.

The relationship of the case 20, gripper jaws 40 and 41 and the bullet is shown enlarged in FIG. 11. It is apparent that the mouth of the bullet case 20 will begin to pass over the bullet to engage it. The gripper jaws 40 and 41 will spread as a consequence of the bevel 70 at the end of die 23 when the ram 11 and case 20 thereon are moved upward a little more.

In FIG. 12 the ammunition case 20 has been elevated further. Note that the neck 38 of feeder body 37 has slid up on the hexagon bullet guide 33 and is stopped against mounting plate 30. Observe that the gripper jaws 40, 41 are now spread apart by reason of their internal taper being pushed against the beveled or chamfered rim 70 of the die body 23. Spreading of jaws 40 and 41 is allowed because the jaws are integral with the deflectable springy fingers 74 and 75 of shuttle 39. An enlargement of the parts that corresponds with their position in FIG. 12 is shown in FIG. 13. FIG. 13 shows the jaw spreading action resulting from jaws 40 and 41 encountering the rounded edge 70 at the rim of die body 23. The bullet 65 is now held in a stable condition by case 20.

From the FIG. 12 position of the ram 11 it continues to move up and arrives at its topmost position depicted in FIG. 15. Case 20 has been pushed nearly through the spread apart gripper jaws. The bullet 65 has been fully seated in case 20 by reason of seating element 25 having been stopped against adjustment screw 27. The next thing that will happen is that the operator will start to return the operating lever 13 towards its inactive position as depicted in FIG. 1. When the ram 11 begins to descend the reloaded case 20 begins to withdraw from die 23. Spring 80 just begins to become decompressed while the neck 38 on feeder body 61 stays up on the hexagon bullet guide member 33 for the moment. Finally the attachment member 44 which attaches to the ram descends enough with the ram for the spring to fully expand and for the member 44 to impinge on hexagon head 82 of the accumulator 45. The downward force thereby applied to actuator rod 43 to accumulator 45 rotates link 31 clockwise in FIG. 15. The linkage length and pivot points are arranged such that at first the feeder body 37 is pulled down to the level in which it appears in FIG. 7, for example. Then, in coordination with the continuing downward ram stroke, the actuator rod 43 pulls on link 31 to turn crank 42 to cause retraction of the shuttle to the level where its jaws 40, 41 can grip the bullet 65 that is on pedestal 36 in readiness for the shuttle to make another advancement excursion.

FIGS. 16–21 depict an alternative embodiment of the bullet feeder wherein parts that are identical to parts of the previously described embodiment are given the same reference numerals.

As shown in FIG. 16, a support plate or bracket 130 supports the new bullet feeder from press 10 by the plate being clamped to the press with a nut 28 on bullet seater die 23. As in the previously described embodiment, the feeder comprises a stationary bullet guide member 33 which has a vertical bore. A feeder body 37 has a neck in the form of a hollow member 38 which fits onto bullet guide member 33 to provide for enabling body 37 to move up and down within limits. The opening in neck 38 has a polygonal cross section that mates with the complementarily shaped polygonal perimeter of guide member 33. Thus, body 37 can slide on but can not turn on bullet guide member 33. The mating polygons join parts 33 and 38 in the manner of a spline.

The shuttle 39 is slidable horizontally on feeder body 37. How this is implemented can be seen in FIGS. 17 and 18. These figures show that the base or bottom web 62 of feeder body 37 has an elongated slot 63. A shouldered slider 71 runs in slot 63. Screw 64 passes through slider 71 and screws into shuttle 39, thereby retaining shuttle 39 against falling off the feeder body but allowing slider 71 and shuttle 39 to move together on the feeder body 37. The crank shaft 58 of crank 42 extends into slider 71.

FIG. 16 and other figures show that neck 38 on body 37 has an integrally molded eye 91. One end of a spring 92 is hooked into eye 91. The other end of the spring hooks into a hole in one end 93 of a tab 94 which is preferably made of metal. Tab 94 is secured by the head of screw 64 to slider 71 and, hence, to shuttle 39. In FIGS. 16 and 17 spring 92 is stretched and is under tension and is therefore tending to pull presently blocked shuttle 39 away from its fully retracted position in which it is shown in these figures toward its advanced position to the left. A horizontal component of force exerted by rod 42 opposes the force of spring 92 in FIG. 16.

Figure 21:
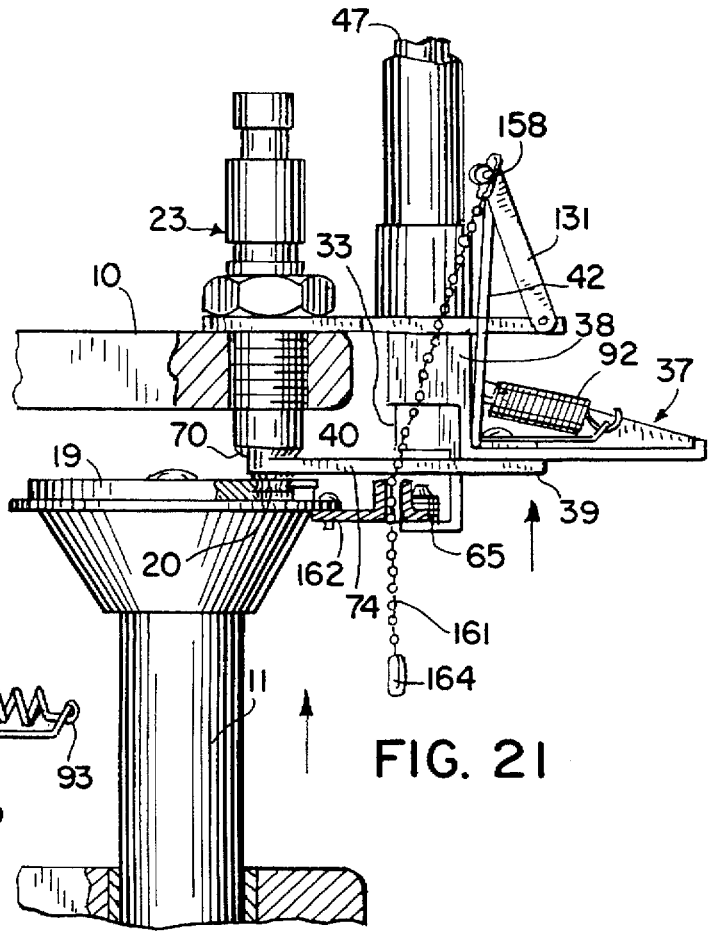
FIG. 21 is a side elevational view wherein the bullet has been pushed out of the jaws of the shuttle by the upwardly moving case on the ram of the press and the bullet is being seated inside of the die.

In FIG. 21 the upward force of ram 11 has pushed case 20 into bullet seating die. A further small upward movement of the ram will, as in FIG. 13, cause the internally tapered gripper jaws 40 and 41 to impinge on the beveled end 70 and spread to release the case 20. Observe that, finally in FIG. 21, ram 11 is pushing against the shuttle jaws. This lifts the feeder body 37 on bullet guide member 38. The advantage of this yielding of the body 37 is that the strong force needed to seat the bullet in a casing is derived directly from the ram rather than to have any more of the force transmitted through the bullet feeder parts.

When seating of the bullet 65 in case 20 is completed, the press operator swings the operating handle 13 upwardly and the ram 11 starts to move down. The first part of the movement permits feeder body 37 to slide down on bullet guide member 33. Continued movement of the ram cause the terminal piece 164 on the chain to be met by coupling element 162 as shown in FIG. 16. The link 131 and crank 42 action is such that the shuttle begins to retract under the force of the chain. The gripper jaws 40, 41 being on flexible fingers 74 and 75 of the shuttle, spread apart and pull off of the case. When the shuttle is almost fully retracted, the elastically supported jaws slide over and grip the next bullet 65 on platform 67. The bullet 65 on the platform 67 settled onto the platform from the stack of bullets in tube 46 or 47, whichever is in use, as soon as the space between the flexible fingers 74 and 75 was clear.

The bullet seating operation can be performed, starting from conditions prevailing in FIG. 16, at a speed limited only by the speed at which an operator can swing the handle 13. As is apparent in FIGS. 16 and 19 shuttle 39 has spaced apart springy fingers 74 and 75 as in the previously described embodiment. The fingers have cooperating bullet gripper jaws as in the described where they are marked 40 and 41 although jaw 41 is obscured by jaw 40 in the second embodiment.

In the FIGS. 16–21 embodiment a link 131 is pivotally connected with pin 132 to the bullet feeder support plate or bracket 130. A crank shaft 157 on the end of crank 42 is pivotally connected to an end of link 131 and is retained in an elongated freeplay opening in a closed metal loop 158. A snap-on retainer holds crank shaft 157 and loop 158 together as shown in FIG. 17. A chain 161 is connected to loop 158. A coupling element 162 couples the chain 161 to ram 11. The chain extends through the neck 163 of element 162 and is prevented from withdrawing by the stopper 164 that is fixed on the end of the chain. One function of the chain is to hold link 131, crank 42, body 37 and shuttle 39 in the positions in which they appear in FIG. 16 in response to the ram having descended to its lower limit as is the case in that figure. The holding force is necessary to prevent the stored energy in stretched spring 94 from propelling the shuttle 39 to its most advanced position which it should only do in response to the ram moving upwardly.

Figure 20:
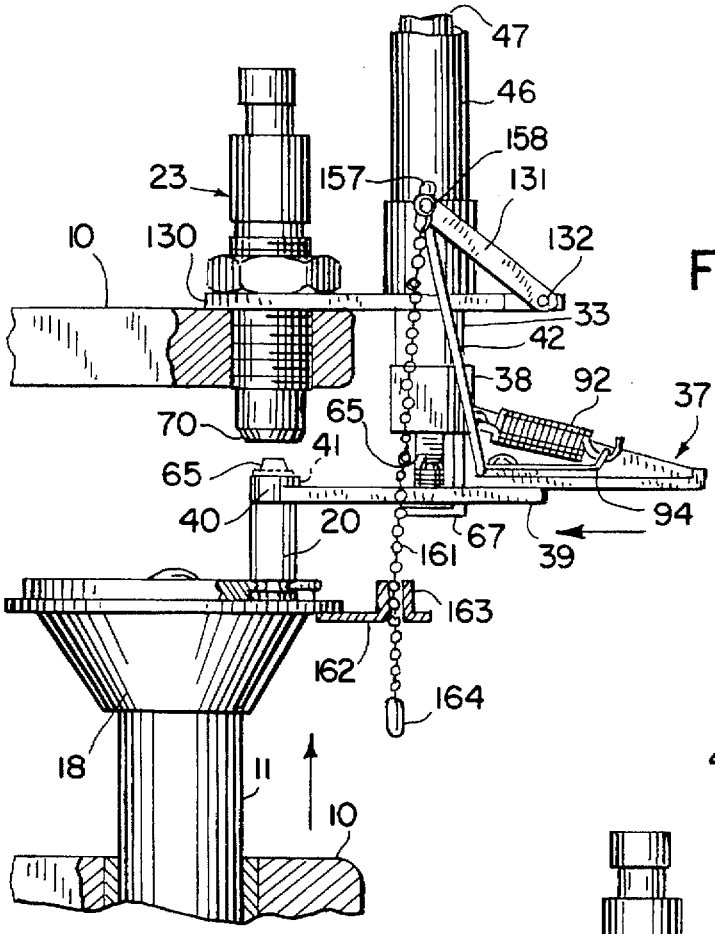
FIG. 20 is a side elevation view of the bullet feeder depicted in a state of operation in which the shuttle has advanced a bullet into alignment with an ammunition case and a bullet seater die where the case is partially slid onto the bullet.
Figure 19:
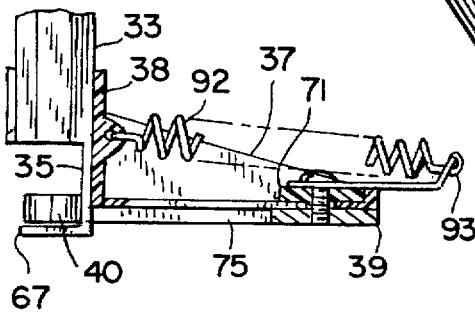
FIG. 19 is a vertical section taken on a line corresponding to 19—19 in FIG. 17.

In FIG. 16 the bullet feeder is ready to position a bullet where it can be accepted in an ammunition case 20 and subsequently be seated in the case by die 23. In FIG. 20 the ram 11 is moving upwardly from its lower limit position. Upward movement has relieved the restraint applied by the chain indirectly to the spring 92. The spring 92 contracts as in FIG. 20, thereby advancing the shuttle 39 as shown. Case 20 is presently slipped partly onto bullet 65 and is spreading the gripper jaws 40 and 41 as the case goes up. After the bullet is seated in die 23, the operator causes the ram to start to descend. When chain 161 acquires some tension it begins to operate the link 131 and crank 42 to stretch or create tension in spring 37. Body 37 drops down to position the shuttle at the level at which it exists in FIG. 16. When tensioned, the spring retracts the shuttle fully. When the shuttle arrives near fully retracted position it grips the bullet 65 on platform 67 and is ready to perform another bullet seating operation in a moment.

I claim:

1. An automatic bullet feeder adapted to be operated in response to the positions of a ram in an ammunition reloading press, said bullet feeder comprising:

a bullet guide member for being supported in proximity with a reloading press, said guide member containing a passageway having an upper end for bullets to enter and a lower end for bullets to exit, a bullet feeder body slidably mounted to said bullet guide member, member that is fixedly supported to said bullet guide member and has a platform positioned in spaced relationship with respect to said lower end of said passageway and is in alignment therewith to provide for a bullet that exits from said lower end to settle on said platform, a shuttle device mounted to said bullet feeder body for moving alternatingly between a retracted position and an advanced position, said shuttle device having an opening through which a bullet passes from said lower end of said passageway to said platform when said shuttle is moved away from said retracted position, said shuttle device carrying resiliently biased gripper elements positioned on said shuttle device for gripping a bullet that is on said platform when said shuttle device is moving toward the retracted position to provide for said bullet to be presented to a reloading press when said shuttle device is advanced, and mechanism for coupling an ammunition case reloading press to said shuttle device for moving said shuttle device alternatingly between advanced and retracted positions in response to operation of the press.

2. A bullet feeder according to claim 1 wherein:

said shuttle device has elongated spaced apart resiliently deflectable finger elements having corresponding end portions fixed to said shuttle device and having opposite corresponding free end portions free to flex toward and away from each other, said gripper elements are jaw elements and one of said jaw elements is fixed on each of said free end portions, respectively, of said deflectable finger elements, said jaw elements are spaced apart by a predetermined amount when said finger elements are undeflected as when there is no bullet between said jaw elements and said jaw elements are deflected apart to accept between them a bullet that is on said platform when said shuttle device is retracting.

3. A bullet feeder according to any one of claims 1 or 2 including:

a tubular member for containing a column of bullets, an adapter member for coupling said tubular member to said bullet guide member for bullets to descend by gravity from said tubular member through said guide member for settling on said platform, and said lower end of said bullet guide member is spaced from said platform by a distance that allows only the entirety of one bullet at a time between said lower end of said guide member and said platform.

4. A bullet feeder according to any one of claims 1 or 2 wherein said bullet feeder body is mounted on said bullet guide member for being raised and lowered in response to movements of said shuttle device and said bullet feeder body is constrained against turning on said bullet guide member.

5. An automatic bullet feeder adapted to be operated in response to varying the vertical position of a ram in an adjacent ammunition case reloading press, said bullet feeder comprising:

a fixedly supported bullet guide member containing a vertical bore with an upper bullet infeed end and a lower bullet exiting end from which bullets exit in succession under the influence of gravity, a bullet feeder body mounted for sliding up and down on said bullet guide member but constrained against rotation, a shuttle device mounted to said bullet feeder body for moving horizontally alternatingly between a retracted position and an advanced position, said shuttle device having horizontally projecting resiliently flexing spaced apart fingers, a fixedly mounted platform element attached to said bullet guide member and arranged for supporting a bullet exiting from said lower end of said bore to descend between said fingers when said shuttle device has moved at least part of the distance from its retracted position to its advanced position, bullet gripping elements in corresponding positions on said fingers for cooperating to grip a bullet on said platform element when said shuttle device is moving toward the retracted position to provide for presenting the bullet to an ammunition reloading press when said shuttle device moves to advanced position, and mechanism for coupling an ammunition case reloading press to said shuttle device for moving said shuttle device in response to operation of the press.

6. A bullet feeder according to claim 5 including a supporting member for said platform element, said supporting member extending downwardly from said bullet guide member for supporting said platform element at a distance from said lower bullet exiting end of said bullet guide member such that at least one but less than two full length bullets can fit between said guide member and said platform element at one time.

7. A bullet feeder according to claim 6 wherein the width of said supporting member is less than the width of the space between said fingers to provide for said fingers to pass said platform element supporting member with said supporting member between said fingers when said shuttle is advancing and retracting.

8. A bullet feeder according to claim 5 wherein said bullet feeder body includes a portion having a polygonally shaped opening and said bullet guide member has a corresponding polygonally shaped cross section to provide for said bullet feeder body sliding on said bullet guide member while being constrained against rotating.

9. An automatic bullet feeder according to anyone of claims 1, 5, 6, 7, or 8 wherein said mechanism comprises:

a support member adapted for being fastened to a reloading press and to said bullet feeder for supporting the bullet feeder, a link pivotally connected to said support member, a generally vertically extending actuator rod having a nominally upper end portion pivotally connected to said link at a place that is at a first distance from where said link is pivotally connected, an actuator rod coupling device adapted for coupling the ram of an ammunition case reloading press to said actuator rod for pushing up and pulling down said actuator rod with corresponding movements of the ram to thereby pivot said link in opposite directions, a crank member having one end portion pivotally connected to said link at a place more remote from said actuator rod and having an opposite end portion pivotally connected to said shuttle device, the sum of the length of said link from its pivot connection to the place where said crank member is connected plus the length of the crank causing said link to pivot in one direction and to cause said shuttle device to be moved to said retracted position for gripping a bullet when said actuator rod is pulled down, pushing said actuator rod upwardly initially causing said link to pivot in the direction opposite of said one direction and said shuttle to be moved to advanced position, and pushing said actuator rod further when said shuttle is in its most advanced position causing said bullet feeder body to begin to move upwardly on said bullet guide member thereby raising the shuttle on the body and the bullet on the shuttle to a higher level and further upward pushing of the actuator rod positioning said bullet for being pressed into an ammunition case.

10. An automatic bullet feeder according to claim 9 wherein said actuator rod coupling device comprises:

a connector member for being connected to the ram of an ammunition case reloading press, said member having an aperture, a tubular body positioned concentrically on said actuator rod and passing through said aperture, said tubular body having opposite ends disposed, respectively, above and below said connector member, a friction element fixed at one end of said tubular body in frictional engagement with said actuator rod and a stop member fixed on said tubular member at an end opposite of said one end, and a helical spring disposed concentrically to said tubular body between said connector member and said friction element.

11. An automatic bullet feeder according to claim 10 wherein said one end of said tubular body, has a thread and said friction element is turned onto said thread, and said friction element has a diametrically thin axially extending portion that effects the frictional engagement with said actuator rod.

12. An automatic bullet feeder according to claim 9 wherein:

when said shuttle device is fully advanced a bullet held in said bullet gripping elements becomes aligned with a bullet seating die secured in an ammunition case reloading press and becomes aligned with an ammunition case mounted to the ram of the press, upward movement of said ram causing said case to engage the bullet, continuing upward movement causing said bullet feeder body, said shuttle, said bullet and said case to move up together for said bullet to start entering said die, continuing upward movement of said ram causing said bullet gripping elements to be spread apart due to being forced against a rim on the die for releasing the gripping elements from the bullet and case, continuing upward movement of the ram causing said casing and bullet to enter the die for pressing the bullet into the casing, and downward movement of said ram then lowering said case and bullet therein from between said gripping elements while said bullet feeder body and shuttle lower together, and continued lowering of said ram causing concurrent downward pull of said actuator rod causing said shuttle to move to retracted position for gripping another bullet.

13. An automatic bullet feeder according to any one of claims 1, 2, 5, 6, 7, or 8 wherein said mechanism comprises:

a support member adapted to be fastened to an ammunition reloading press and to said bullet feeder to support said bullet feeder, a link having one end and an opposite end, the one end is pivotally connected to said support member, a crank member having one end and an opposite end, the one end is connected to the shuttle, said opposite ends of said crank member and said link being connected at a common pivot and including a flexible element adapted for being coupled to said common pivot and to said ram, and a spring connected to said shuttle for biasing said shuttle toward the advanced position.

14. An automatic bullet feeder according to claim 3 wherein said mechanism comprises:

a support member adapted to be fastened to an ammunition reloading press and to said bullet feeder to support said bullet feeder, a link having one end and an opposite end, the one end is pivotally connected to said support member, a crank member having one end and an opposite end, the one end is connected to the shuttle, said opposite ends of said crank member and said link being connected at a common pivot and including a flexible element adapted for being coupled to said common pivot and to said ram, and a spring connected to said shuttle for biasing said shuttle toward the advanced position.

* * * * *